US006428140B1

(12) United States Patent
Cruz-Uribe

(10) Patent No.: US 6,428,140 B1
(45) Date of Patent: Aug. 6, 2002

(54) RESTRICTION WITHIN FLUID CAVITY OF FLUID DROP EJECTOR

(75) Inventor: Antonio S Cruz-Uribe, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/967,831

(22) Filed: Sep. 28, 2001

(51) Int. Cl.[7] ..... B41J 2/015
(52) U.S. Cl. ..... 347/20
(58) Field of Search ..... 347/20, 21, 27, 347/44, 47, 48, 50, 40, 54, 65, 63, 70–72, 60–69; 399/261; 361/700; 29/890.1; 310/328–330

(56) References Cited

U.S. PATENT DOCUMENTS

| | | | | |
|---|---|---|---|---|
| 4,533,082 A | | 8/1985 | Maehara et al. | 239/102 |
| 4,605,167 A | | 8/1986 | Maehara | 239/102 |
| 5,152,456 A | | 10/1992 | Ross et al. | 239/102.2 |
| 5,255,016 A | | 10/1993 | Usui et al. | 346/140 R |
| 5,513,431 A | | 5/1996 | Ohno et al. | 29/890.1 |
| 5,518,179 A | | 5/1996 | Humberstone et al. | 239/102.2 |
| 5,828,394 A | | 10/1998 | Khuri-Yakub et al. | 347/72 |
| 6,074,043 A | * | 6/2000 | Ahn | 347/54 |
| 6,084,616 A | * | 7/2000 | Nakata et al. | 347/65 |
| 6,127,198 A | * | 10/2000 | Coleman et al. | 438/21 |
| 6,273,552 B1 | * | 8/2001 | Hawkins et al. | 347/48 |
| 6,291,927 B1 | | 9/2001 | Percin et al. | 310/324 |
| 6,318,841 B1 | * | 11/2001 | Coleman et al. | 347/44 |
| 6,331,045 B1 | * | 12/2001 | Harvey et al. | 347/54 |

FOREIGN PATENT DOCUMENTS

| | | | |
|---|---|---|---|
| EP | 0655334 A1 | 5/1995 | |
| EP | 1075949 A2 | 2/2001 | |
| WO | WO93/01404 | 1/1993 | G01D/15/18 |
| WO | WO 93/10910 | 6/1993 | |
| WO | WO 97/12689 | 4/1997 | |
| WO | WO01/62394 A2 | 8/2001 | |

OTHER PUBLICATIONS

Percin et al., Micromachined 2–D Array Piezoelectrically Actuated Flextensional Transducers: New Designs. Part of the SPIE Conference on Micromachined Devices and Components IV, Santa Clara, California, Sep. 1998; SPIE vol. 3514, pp. 411–414.

(List continued on next page.)

*Primary Examiner*—John Barlow
*Assistant Examiner*—K. Feggins

(57) ABSTRACT

A fluid drop ejector adapted to eject droplets of a fluid includes a substrate having a fluid cavity defined therein, a flexible membrane supported by the substrate, and an actuator associated with the flexible membrane. The flexible membrane has an orifice defined therein which communicates with the fluid cavity and the actuator is adapted to deflect the flexible membrane relative to the substrate to eject droplets of the fluid through the orifice in response to an electrical signal applied to the actuator. A restriction is positioned within the fluid cavity opposite the orifice so as to define a confining region of the fluid cavity adjacent the orifice. As such, a perimeter of the restriction is spaced from a sidewall of the fluid cavity.

46 Claims, 8 Drawing Sheets

OTHER PUBLICATIONS

Percin et al., Controlled Ink–Jet Printing and Deposition of Organic Polymers and Solid Particles. Applied Physics Letters, vol. 73, No. 16, Oct. 19, 1998, pp. 2375–2377.
Percin et al., Micromachined Two–Dimensional Array Piezoelectrically Actuated Transducers. Applied Physics Letters, vol. 72, No. 11, Mar. 16, 1998, pp. 1397–1399.
Percin et al., Micromachined 2–D Array Piezoelectrically Actuated Flextensional Transducers and Inkjet Print Heads. Electrochemical Society Proceedings vol. 98–14, pp. 87–93.
Percin et al., Resist Deposition without Spinning by Using Novel Inkjet Technology and Direct Lithography of MEMS. SPIE vol. 3333, pp. 1382–1389.
Percin, G., Micromachined Piezoelectrically Actuated Flextensional Transducers for High Resolution Printing and Medical Imaging, 1999, pp. 1–23.
Percin et al., Piezoelectrically Actuated Transducer and Droplet Ejector. 1996 IEEE Ultrasonics Symposium, pp. 913–916.
Percin et al., Piezoelectrically Actuated Droplet Ejector. Review of Scientific Instruments, vol. 68, No. 12, Dec. 1997, pp. 4561–4563.
Percin et al., Micromachined 2–D Array Piezoelectrically Actuated Flextensional Transducers. 1997 IEEE Ultrasonics Symposium, pp. 959–962.

* cited by examiner

RESTRICTION WITHIN FLUID CAVITY OF FLUID DROP EJECTOR

THE FIELD OF THE INVENTION

The present invention relates generally to fluid drop ejectors, and more particularly to a restriction within fluid cavity of fluid drop ejector.

BACKGROUND OF THE INVENTION

Fluid drop ejectors have been developed for ejecting droplets of a flowable material in a controlled manner. As illustrated in FIGS. 1A and 1B, a conventional fluid drop ejector 90 includes a cylindrical body 92, a circular flexible membrane 94 having an orifice 96 defined therein, and an annular actuator 98. The cylindrical body defines a reservoir for holding a supply of flowable material and the circular flexible membrane has a circumferential edge clamped to the cylindrical body. The annular actuator includes a piezoelectric material which deforms when an electrical voltage is applied. As such, when the piezoelectric material deforms, the circular flexible membrane deflects causing a quantity of flowable material to be ejected from the reservoir through the orifice.

One application of a fluid drop ejector is in an inkjet printing system. As such, the inkjet printing system includes a printhead having a plurality of fluid drop ejectors that eject droplets of ink through orifices or nozzles to form an image on a print medium. By increasing a velocity of droplets ejected from the fluid drop ejectors, trajectory errors of the droplets are minimized. As such, image quality of the inkjet printing system is enhanced.

One way to increase a velocity of droplets from the fluid drop ejector is to increase a pressure of fluid throughout the reservoir or fluid cavity of the fluid drop ejector. However, increasing a pressure of fluid throughout the fluid cavity requires that a stiffness of the flexible membrane be increased since the flexible membrane must sustain the pressure generated throughout the fluid cavity. Unfortunately, increasing the stiffness of the flexible membrane reduces a compliancy or flexibility of the flexible membrane and requires that a greater force be applied to deflect the flexible membrane.

Accordingly, a need exists for a fluid drop ejector which provides an increased velocity of droplets which are ejected from the fluid drop ejector. More particularly, a need exists for a fluid drop ejector which increases a pressure on fluid within a fluid cavity of the fluid drop ejector without requiring an increased stiffness of a flexible membrane of the fluid drop ejector.

SUMMARY

One aspect of the present invention provides a fluid drop ejector. The fluid drop ejector includes a substrate having a fluid cavity defined therein, a flexible membrane supported by the substrate and having an orifice defined therein which communicates with the fluid cavity, an actuator associated with the flexible membrane and adapted to deflect the flexible membrane relative to the substrate in response to an electrical signal, and a restriction positioned within the fluid cavity opposite the orifice As such, the restriction defines a confining region of the fluid cavity adjacent the orifice and a perimeter of the restriction is spaced from a sidewall of the fluid cavity.

Another aspect of the present invention provides a method of forming a fluid drop ejector. The method includes defining a fluid cavity in a substrate, supporting a flexible membrane by the substrate, communicating an orifice of the flexible membrane with the fluid cavity, positioning a restriction within the fluid cavity opposite the orifice, and associating an actuator with the flexible membrane, wherein the actuator is adapted to deflect the flexible membrane relative to the substrate in response to an electrical signal.

Another aspect of the present invention provides a method of ejecting droplets of a fluid. The method includes supplying a fluid cavity with the fluid, supporting a flexible membrane having an orifice defined therein over the fluid cavity so as to communicate the orifice with the fluid cavity, confining the fluid within the fluid cavity in a region adjacent the orifice with a restriction having a perimeter spaced from a sidewall of the fluid cavity, and deflecting the flexible membrane relative to the fluid cavity and ejecting a droplet of the fluid through the orifice of the flexible membrane.

Another aspect of the present invention provides an inkjet printing system. The inkjet printing system includes a substrate having a plurality of fluid cavities formed therein, a plurality of flexible membranes each supported by the substrate and having an orifice defined therein which communicates with one of the fluid cavities, a plurality of restrictions each positioned within one of the fluid cavities opposite the orifice of a respective one of the flexible membranes, and a plurality of actuators each associated with one of the flexible membranes. As such, each of the restrictions define a confining region of the one of the fluid cavities adjacent the orifice of the respective one of the flexible membranes and a perimeter of each of the restrictions is spaced from a sidewall of a respective one of the fluid cavities. In addition, each of the flexible membranes is adapted to deflect in response to application of an electrical signal to an associated one of the actuators.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1A:
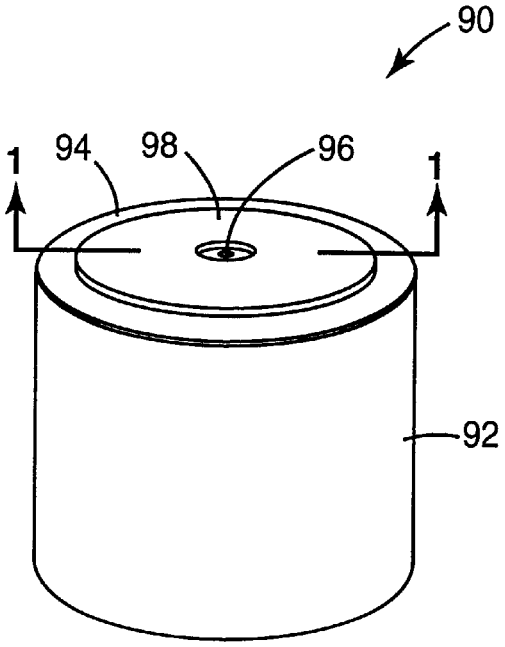
Fig. 1A PRIOR ART
FIG. 1A is a perspective view of a portion of a prior art fluid drop ejector.
Figure 1B:
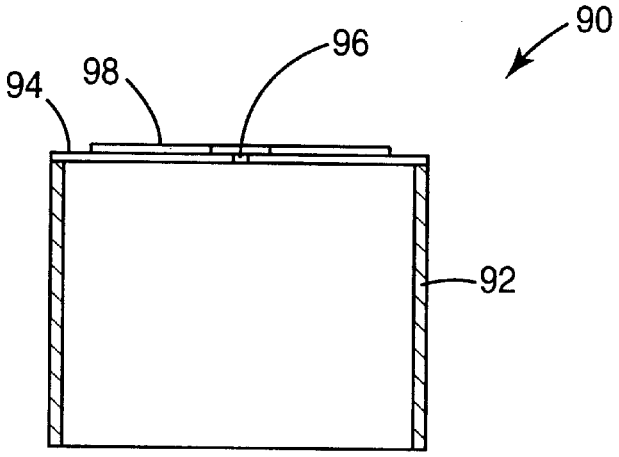
Fig. 1B PRIOR ART
FIG. 1B is a cross-sectional view taken along line 1—1 of FIG. 1A.
Figure 2:
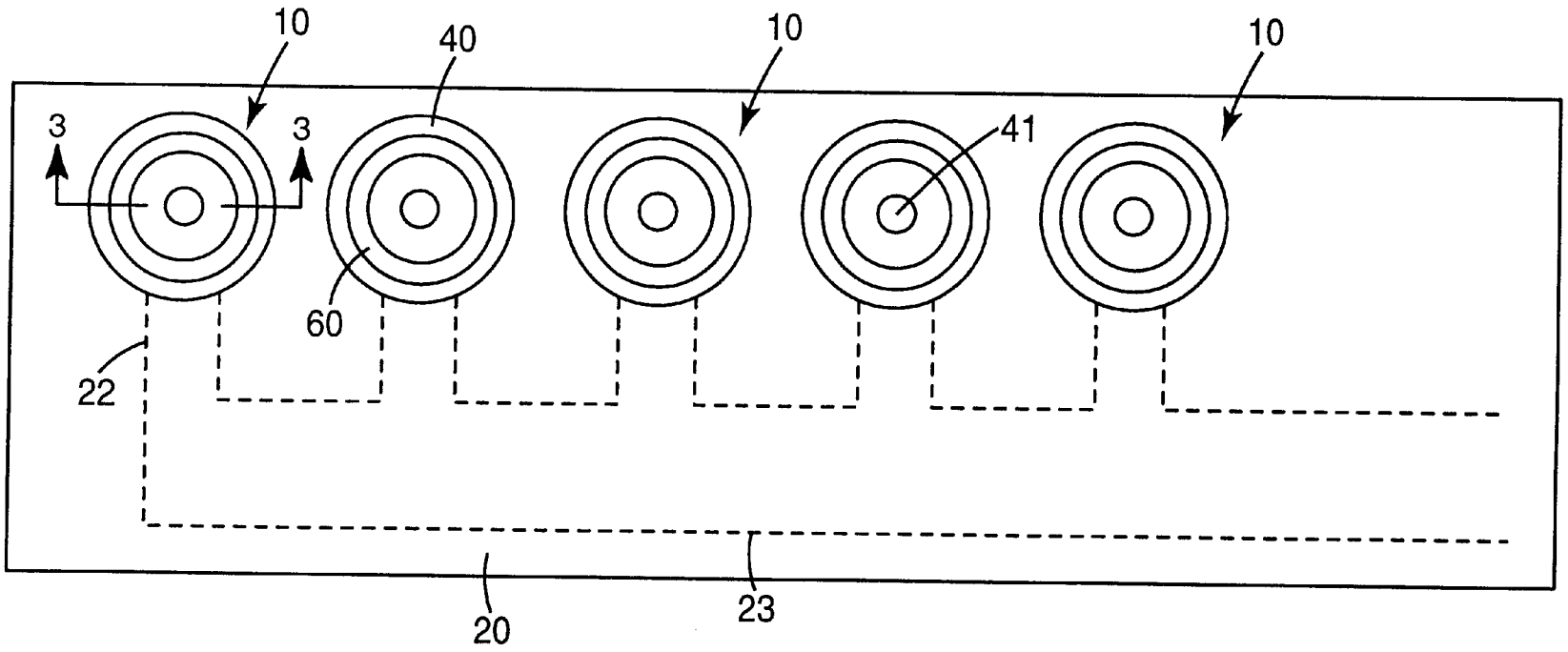
FIG. 2 is a schematic top view illustrating one embodiment of a plurality of fluid drop ejectors according to the present invention.

FIG. 2 illustrates one embodiment of a plurality of fluid drop ejectors 10 arranged to form an array of fluid drop ejectors 10. Each fluid drop ejector 10 is a fluid drop ejection device capable of ejecting droplets of a flowable material. Each fluid drop ejector 10 may include drop-on-demand and/or continuous modes of operation. For clarity, the following description refers to the ejection of fluid from fluid drop ejectors 10. Fluid, as used herein, is defined to include any flowable material, including a liquid such as water, ink, blood, or photoresist and flowable particles of a solid such as talcum powder.

In one embodiment, each fluid drop ejector 10 includes a supporting structure or substrate 20, a flexible membrane 40, and an actuator 60. While the plurality of fluid drop ejectors 10 are illustrated as being formed with a single substrate, it is understood that fluid drop ejectors 10 may be formed separately from each other with distinct substrates. Thus, for clarity of the invention, the following description refers to a single fluid drop ejector 10 formed with a distinct substrate 20.

As illustrated in FIGS. 2–5, substrate 20 has a fluid cavity 21 formed therein. Fluid cavity 21 has an inlet 22 which communicates with a supply of fluid for fluid drop ejector 10. When a plurality of fluid drop ejectors 10 are formed with a single substrate, substrate 20 has a fluid manifold 23 formed therein which distributes fluid to each fluid drop ejector 10 and, more specifically, fluid cavity 21 of a respective fluid drop ejector 10. By forming fluid drop ejectors 10 with separate and distinct fluid cavities 21, fluidic cross-talk between fluid cavities 21 is avoided.

In one embodiment, substrate 20 includes a sidewall 24 and a base 25 which define fluid cavity 21. As such, sidewall 24 constitutes a sidewall of fluid cavity 21 and base 25 constitutes a base of fluid cavity 21. Preferably, fluid cavity 21 is cylindrical in shape. Thus, sidewall 24 is a cylindrical sidewall and base 25 includes a circular portion. While substrate 20 is illustrated as having an exterior profile which is square in shape, it is understood that the exterior profile of substrate 20 may be other shapes such as round or rectangular.

Flexible membrane 40 is supported by substrate 20 and extends across or over fluid cavity 21 such that fluid cavity 21 and flexible membrane 40 define a fluid reservoir 26. As such, fluid reservoir 26 holds or contains fluid for fluid drop ejector 10. As described below, deflection of flexible membrane 40 causes ejection of fluid from fluid reservoir 26.

Flexible membrane 40 has an orifice 41 defined therein which communicates with fluid cavity 21. As such, when fluid cavity 21 is supplied with fluid, the fluid communicates with orifice 41. Orifice 41 defines a nozzle for ejecting a quantity of fluid from fluid cavity 21 in response to deflection of flexible membrane 40, as described below.

Flexible membrane 40 is formed of a flexible material such as, for example, a flexible thin layer of silicon or flexible thin film of silicon nitride or silicon carbide. In one embodiment, substrate 20 and flexible membrane 40 are formed of a homogenous material such as, for example, silicon. As such, flexible membrane 40 is formed by a flexible thin layer of silicon extending across fluid cavity 21.

Preferably, flexible membrane 40 is circular in shape and orifice 41 is formed in a center of flexible membrane 40. As such, flexible membrane 40 is supported about a circumference or periphery thereof by substrate 20. Thus, a maximum deflection of flexible membrane 40 occurs at orifice 41 during a symmetric deflection mode.

Actuator 60 is associated with and causes deflection of flexible membrane 40. Preferably, actuator 60 is annular in shape. As such, actuator 60 is positioned concentrically with orifice 41. In one embodiment, actuator 60 is provided and, more specifically, mounted or formed on a side of flexible membrane 40 opposite fluid cavity 21. As such, actuator 60 is not in direct contact with fluid contained within fluid cavity 21. Thus, any potential effects of fluid contacting actuator 60, such as corrosion or electrical shorting, are avoided. While actuator 60 is illustrated as being provided on a side of flexible membrane 40 opposite fluid cavity 21, it is also within the scope of the present invention for actuator 60 to be provided on a side of flexible membrane 40 facing fluid cavity 21.

In one embodiment, actuator 60 includes a piezoelectric material which changes shape, for example, expands and/or contracts, in response to an electrical signal. Thus, in response to the electrical signal, actuator 60 applies a force to flexible membrane 40 which causes flexible membrane 40 to deflect. As such, orifice 41 is located in an area of flexible membrane 40 which achieves maximum deflection when flexible membrane 40 deflects. Examples of a piezoelectric material include zinc oxide or a piezoceramic material such as barium titanate, lead zirconium titanate (PZT), or lead lanthanum zirconium titanate (PLZT). It is understood that actuator 60 may include any type of device which causes movement or deflection of flexible membrane 40 including an electrostatic, magnetostatic, and/or thermal expansion actuator.

Figure 5:
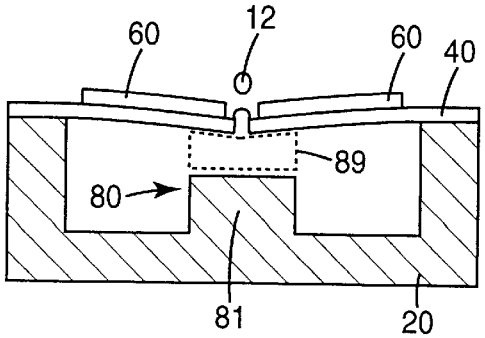
FIG. 5 is a cross-sectional view similar to FIG. 3 illustrating ejection of fluid from the fluid drop ejector of FIG. 3.

As illustrated in FIG. 5, when flexible membrane 40 deflects, a droplet 12 of fluid is formed and ejected from orifice 41 of fluid drop ejector 10. Since flexible membrane 40 is supported or clamped about a periphery thereof, the largest deflection of flexible membrane 40 occurs at or near orifice 41. It is understood that the extent of deflection of flexible membrane 40 illustrated in FIG. 5 has been exaggerated for clarity of the invention.

Cyclical application of an electrical signal to actuator 60 causes flexible membrane 40 to oscillate. Flexible membrane 40 has multiple resonant frequencies and, as such, may oscillate in different resonant vibrational modes. Preferably, flexible membrane 40 oscillates into a lowest order, symmetric resonant vibrational mode with maximum deflection occurring at orifice 41. Fluid drop ejector 10, therefore, ejects droplets 12 of fluid at a predetermined rate and/or at predetermined intervals.

Figure 3:
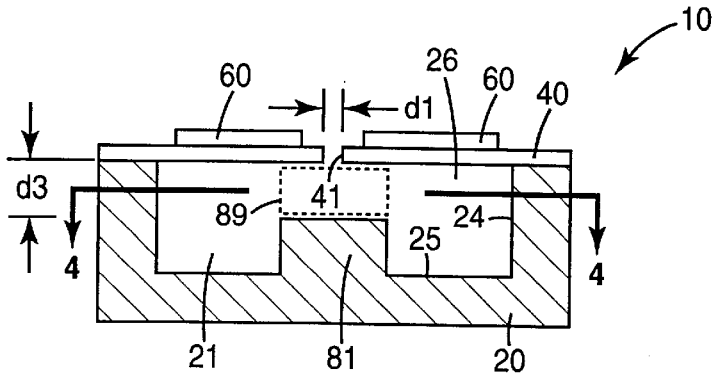
FIG. 3 is a cross-sectional view taken along line 3—3 of FIG. 2 illustrating one embodiment of a confining architecture of a fluid drop ejector according to the present invention.

To increase a pressure on the fluid within fluid cavity 21 in a region of orifice 41, fluid drop ejector 10 includes a confining architecture 80. In one embodiment, as illustrated in FIGS. 3–5, confining architecture 80 includes a restriction 81. Restriction 81 is positioned within fluid cavity 21 opposite orifice 41 and supported by base 25 of fluid cavity 21. As such, restriction 81 defines a confining region 89 within fluid cavity 21 adjacent orifice 41. More specifically, confining region 89 is defined between restriction 81 and flexible membrane 40. Thus, when flexible membrane 40 deflects into fluid cavity 21 in a direction toward base 25 of fluid cavity 21, as illustrated in FIG. 5, a local pressure on fluid in confining region 89 between restriction 81 and flexible membrane 40 is increased. Accordingly, a velocity of droplet 12, as ejected from fluid drop ejector 10, is increased. While restriction 81 is illustrated as being formed integrally with substrate 20, it is within the scope of the present invention for restriction 81 to be formed separately from and joined to substrate 20.

In one embodiment, orifice 41 has a dimension d1 and restriction 81 has a dimension d2. As such, dimension d2 of restriction 81 is greater than dimension d1 of orifice 41. In one illustrative embodiment, a ratio of dimension d2 of restriction 81 to dimension d1 of orifice 41 is in a range of approximately 2 to approximately 3. While orifice 41 is illustrated as having an uniform diameter, it is understood that the diameter of orifice 41 may have other profiles. Preferably, orifice 41 has a tapered profile. Dimension d1, therefore, represents an average hydraulic diameter of orifice 41.

In addition, restriction 81 is spaced a predetermined distance d3 from flexible membrane 40 when flexible membrane 40 is in a neutral position, as illustrated in FIG. 3. In one embodiment, predetermined distance d3 is a function of dimension d1 of orifice 41. In one illustrative embodiment, for example, a ratio of predetermined distance d3 to dimension d1 of orifice 41 is in a range of approximately 1 to approximately 10. In another illustrative embodiment, a ratio of predetermined distance d3 to dimension d1 of orifice 41 is limited to a range of approximately 1 to approximately 3.

Figure 4A:
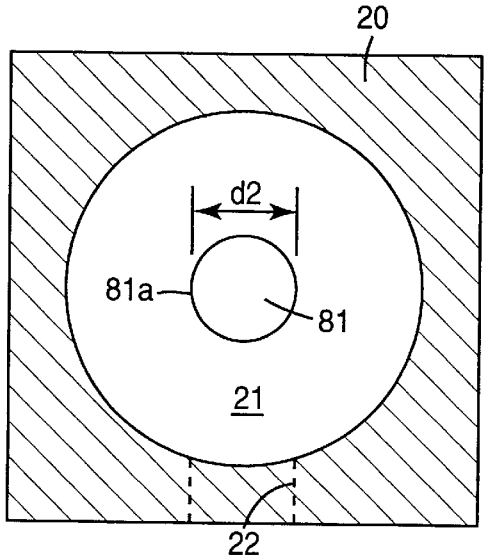
FIG. 4 is a cross-sectional view from the perspective of line 4—4 of FIG. 3 illustrating one embodiment of a restriction of the confining architecture of the fluid drop ejector of FIG. 3.
FIG. 4B is a cross-sectional view from the perspective of line 4—4 of FIG. 3 illustrating another embodiment of a restriction of the confining architecture of the fluid drop ejector of FIG. 3.

FIG. 4A illustrates one embodiment of restriction 81. Restriction 81 is substantially circular in shape and has a perimeter 81*a*. Preferably, restriction 81 is approximately centered in fluid cavity 21 such that perimeter 81*a* is spaced substantially equally from sidewall 24 of fluid cavity 21. As such, fluid within fluid cavity 21 surrounds perimeter 81*a* of restriction 81. Since restriction 81 is substantially circular in shape, dimension d2 of restriction 81 represents a diameter of restriction 81.

Figure 4B:
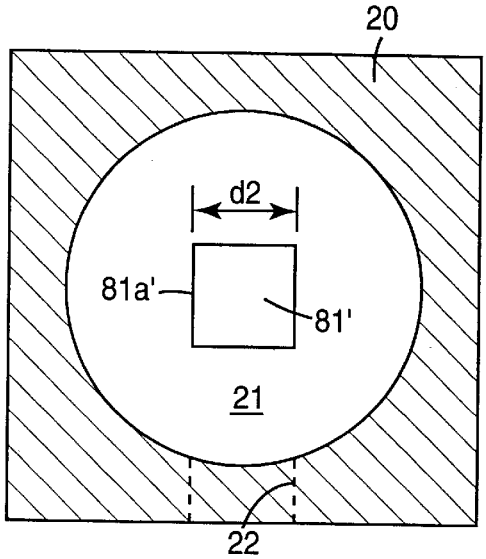

FIG. 4B illustrates another embodiment of restriction 81. Restriction 81' is substantially square in shape and has a perimeter 81*a*'. Preferably, restriction 81' is approximately centered in fluid cavity 21 such that each side of perimeter 81*a*' is spaced substantially equally from sidewall 24 of fluid cavity 21. As such, fluid within fluid cavity 21 surrounds perimeter 81*a*' of restriction 81'. Since restriction 81' is substantially square in shape, dimension d2 of restriction 81' represents a width of restriction 81'.

Figure 6:
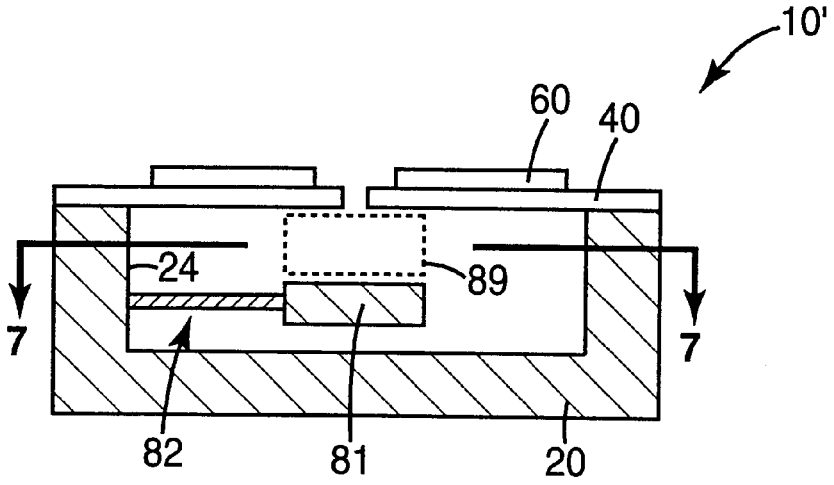
FIG. 6. is a cross-sectional view similar to FIG. 3 illustrating another embodiment of a confining architecture of a fluid drop ejector according to the present inventions
Figure 7:
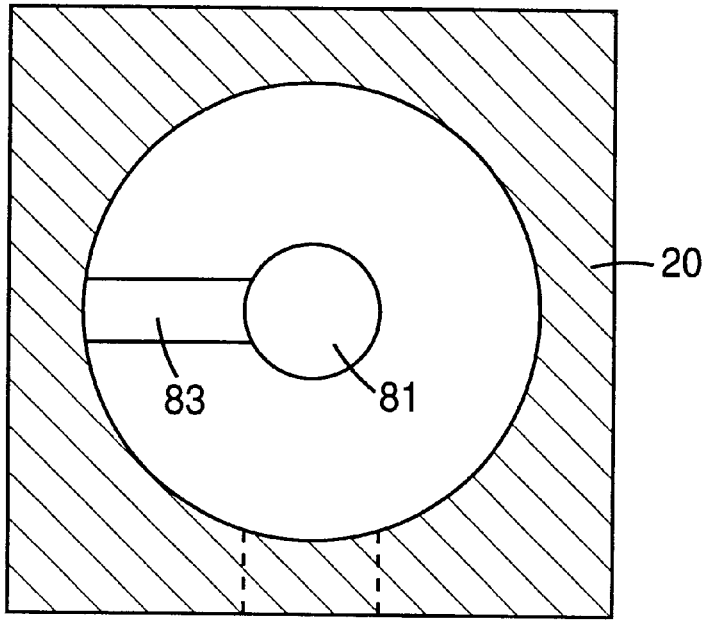
FIG. 7 is a cross-sectional view from the perspective of line 7—7 of FIG. 6.

FIGS. 6 and 7 illustrate another embodiment of fluid drop ejector 10. Fluid drop ejector 10' is similar to fluid drop ejector 10 with the exception that restriction 81 is supported from sidewall 24 of fluid cavity 21. In one embodiment, restriction 81 is supported from sidewall 24 of fluid cavity 21 by a web structure 82.

Web structure 82 includes at least one supporting web 83 which extends between sidewall 24 of fluid cavity 21 and restriction 81. While web structure 82 is illustrated as including one supporting web 83, it is within the scope of the present invention for web structure 82 to include any number of supporting webs 83 extending between sidewall 24 of fluid cavity 21 and restriction 81. Two or more supporting webs 83, for example, may be spaced radially around restriction 81. While supporting web 83 is illustrated as being formed separately from and joined to substrate 20, it is within the scope of the present invention for supporting web 33, substrate 20, and restriction 81 to be formed integrally.

Figure 8:
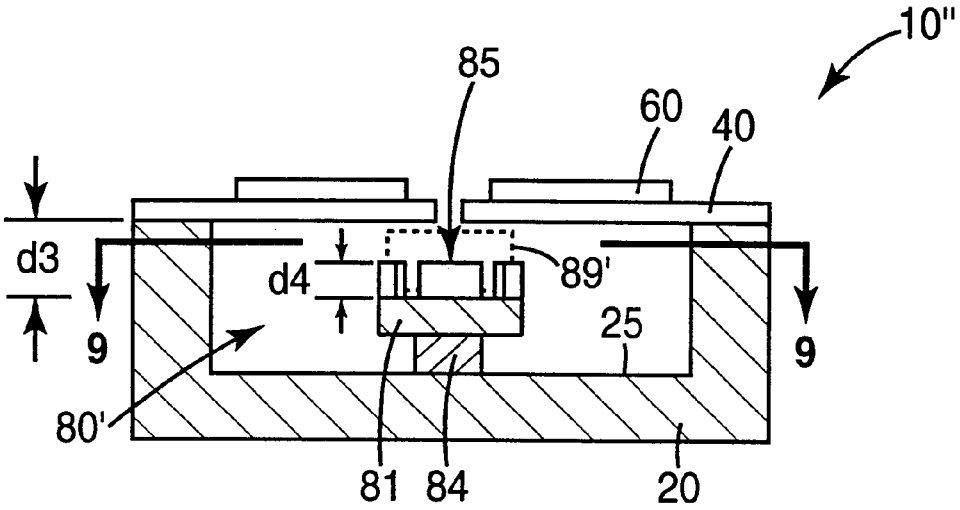
FIG. 8 is a cross-sectional view similar to FIG. 3 illustrating another embodiment of a confining architecture of a fluid drop ejector including one embodiment of a restricting wall according to the present invention.
Figure 9:
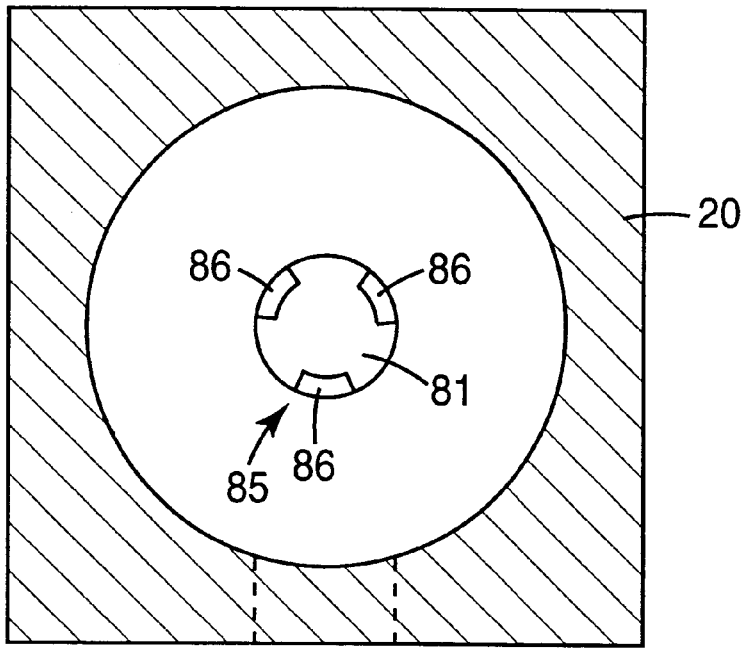
FIG. 9 is a cross-sectional view from the perspective of line 9—9 of FIG. 8.

FIGS. 8 and 9 illustrate another embodiment of fluid drop ejector 10. Fluid drop ejector 10" is similar to fluid drop ejector 10 with the exception that restriction 81 is supported by a pedestal 84 extending from base 25 of fluid cavity 21. As such, pedestal 84 positions restriction 81 at predetermined distance d3 from flexible membrane 40.

In addition, fluid drop ejector 10" includes another embodiment of confining architecture 80. Confining architecture 80' includes restriction 81 and a restricting wall 85. Restricting wall 85 is positioned within fluid cavity 21 and oriented substantially perpendicular to restriction 81. As such, restricting wall 85 and restriction 81 together define a confining region 89' within fluid cavity 21 adjacent orifice 41. More specifically, confining region 89' is defined between restriction 81, restricting wall 85, and flexible membrane 40.

In one embodiment, restricting wall 85 projects from restriction 81 toward flexible membrane 40. Preferably, restricting wall 85 projects from a periphery of restriction 81. In addition, restricting wall 85 is concentric with restriction 81 and orifice 41. Furthermore, restricting wall 85 extends a distance d4 from restriction 81 toward flexible membrane 40. In one illustrative embodiment, distance d4 is at least one half of predetermined distance d3 between restriction 81 and flexible membrane 40.

In one embodiment, as illustrated in FIGS. 8 and 9, restricting wall 85 includes a plurality of spaced fingers or projections 86. As such, projections 86 project from and are spaced circumferentially about a periphery of restriction 81. While restricting wall 85 is illustrated as including three projections 86, it is within the scope of the present invention for restricting wall 85 to include any number of projections 86 from restriction 81. As such, projections 86 may be spaced circumferentially around restriction 81.

By forming restricting wall 85 with projections 86, restricting wall 85 forms a particle tolerant architecture for fluid drop ejector 10". More specifically, projections 86 are spaced to allow fluid to flow therebetween and into confining region 89' while preventing foreign particles from flowing into confining region 89'. Such particles include, for example, dust particles and fibers. Such particles, if allowed to enter confining region 89', may affect a performance of fluid drop ejector 10" by, for example, blocking, either wholly or partially, orifice 41.

Figure 10:
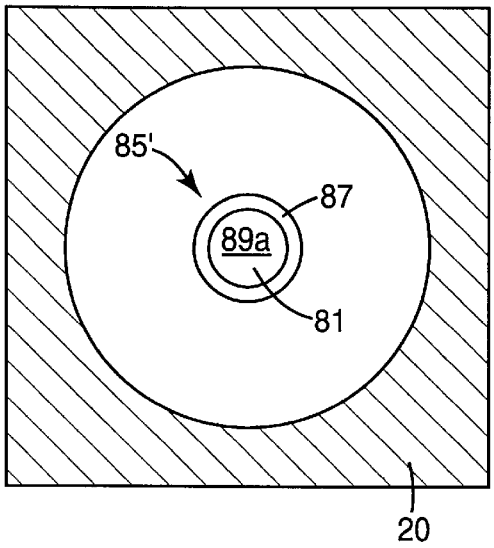
FIG. 10 is a cross-sectional view similar to FIG. 9 illustrating another embodiment of, a restricting wall according to the present invention.
Figure 11:
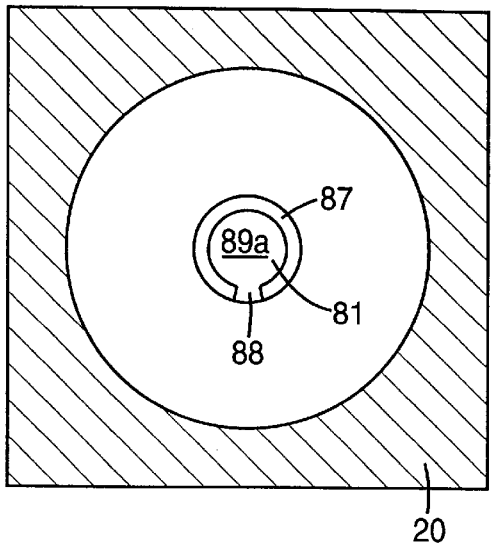
FIG. 11 is a cross-sectional view similar to FIG. 9 illustrating another embodiment of a restricting wall according to the present invention.

FIGS. 10 and 11 illustrate another embodiment of restricting wall 85. Restricting wall 85' includes an annular projection 87 which projects from a periphery of restriction 81 toward flexible membrane 40. Restriction 81 and restricting wall 85' define a cavity or pocket 89*a* of confining region 89'. Thus, fluid in pocket 89*a* is confined by annular projection 87 when flexible membrane 40 deflects toward restriction 81. As such, a local pressure of fluid in confining region 89', including pocket 89*a*, is increased. In one embodiment, as illustrated in FIG. 11, annular projection 87 has a gap 88 defined therein. As such, fluid is permitted to more easily flow into and out of pocket 89*a*. Thus, a pressure of fluid in pocket 89*a* may be controlled by sizing of gap 88.

Figure 12:
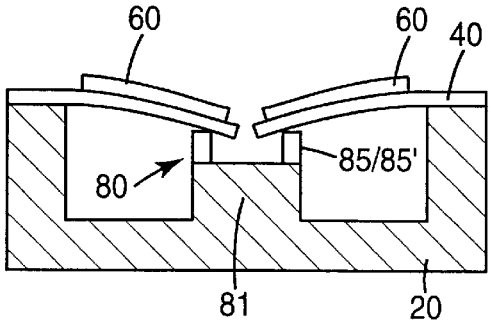
FIG. 12 is a cross-sectional view similar to FIG. 8 illustrating contact of a flexible membrane with the restricting wall to stop oscillation of the flexible membrane.

As described above, cyclical application of an electrical signal to actuator 60 causes flexible membrane 40 to oscillate. Thus, droplets 12 of fluid are ejected, for example, from fluid drop ejector 10" as flexible membrane 40 oscillates. In one embodiment, to stop oscillation of flexible membrane 40 and, therefore, ejection of droplets 12 from fluid drop ejector 10", flexible membrane 40 is deflected to contact restricting wall 85 or restricting wall 85', as illustrated in FIG. 12.

Cyclical application of an electrical signal to actuator 60 is achieved, for example, by application of an alternating voltage to actuator 60. As such, flexible membrane 40 is deflected to contact restricting wall 85 by, for example, application of a pulse of constant voltage to actuator 60. In one embodiment, the alternating voltage to actuator 60 is achieved with a sinusoidal electrical signal and the constant voltage to actuator 60 is achieved with a square pulse electrical signal. The pulse of constant voltage is selected so as to temporarily pin flexible membrane 40 against restricting wall 85 or restricting wall 85' and, more specifically, spaced projections 86 or annular projection 87. In addition, a maximum amplitude of the constant voltage is larger than that applied during oscillation of flexible membrane 40. Furthermore, the pulse of constant voltage is applied for a period of time sufficient to hold flexible membrane in place and stop oscillation.

While restricting wall 85 (including restricting wall 85') is illustrated as projecting from restriction 81 as supported by pedestal 84, it is within the scope of the present invention for restricting wall 85 to project from restriction 81 as supported directly by base 25 of fluid cavity 21 or web structure 82 as supported from sidewall 24 of fluid cavity 21, as illustrated in FIG. 6. In addition, restricting wall 85 may be formed integrally with or separately from restriction 81.

Figure 13:
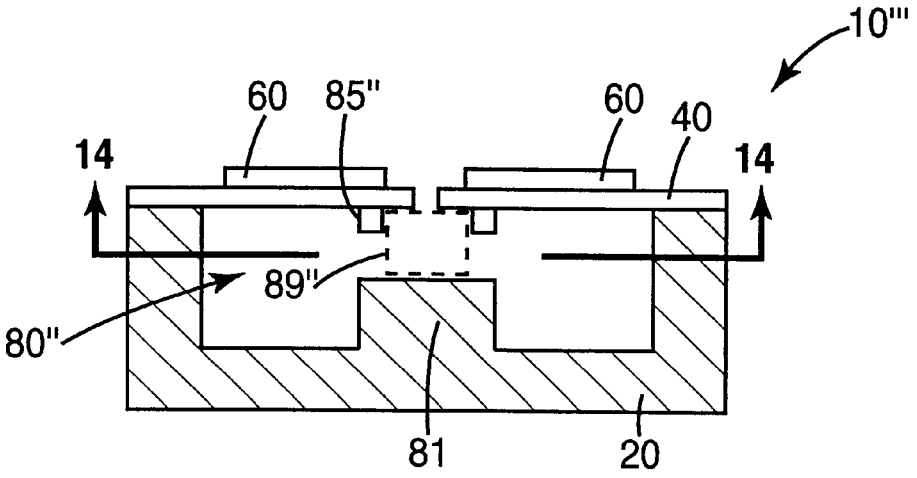
FIG. 13 is a cross-sectional view similar to FIG. 3 illustrating another embodiment of a confining architecture of a fluid drop ejector including another embodiment of a restricting wall according to the present invention.
Figure 14:
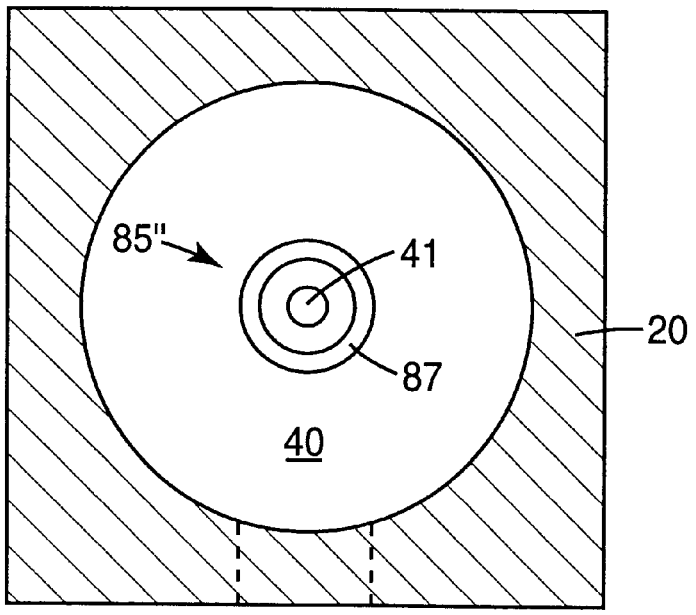
FIG. 14 is a cross-sectional view from the perspective of line 14—14 of FIG. 13.

FIGS. 13 and 14 illustrate another embodiment of fluid drop ejector 10 including another embodiment of restricting wall 85 and, therefore, confining architecture 80. Fluid drop ejector 10'" is similar to fluid drop ejector 10" with the exception that restricting wall 85" projects from flexible membrane 40. More specifically, restricting wall 85" projects from flexible membrane 40 toward base 25 of fluid cavity 21.

Similar to restricting walls 85 and 85', restricting wall 85" includes spaced projections 86 or annular projection 87 with or without gap 88. As such, restriction 81 and restricting wall 85" define confining region 89". More specifically, confining region 89" is defined between restriction 81, flexible membrane 40, and restricting wall 85". Confining architecture 80", therefore, includes restriction 81 and restricting wall 85".

While restriction 81 and restriction 81' are illustrated as being substantially circular in shape and square in shape, respectively, it is within the scope of the present invention for restrictions 81 and 81' to be of other geometric shapes such as rectangular, oval, cardioid, etc. As such, design parameters of confining architectures 89, 89', and 89" are tuned for optimal fluidic performance. More specifically, a shape of restrictions 81 and 81' and dimensions d1, d2, d3, and/or d4 are selected to achieve increased pressure in confining regions 89, 89', and 89" as well as fast refill of fluid cavity 21 without trapping bubbles in fluid cavity 21.

Figure 15:
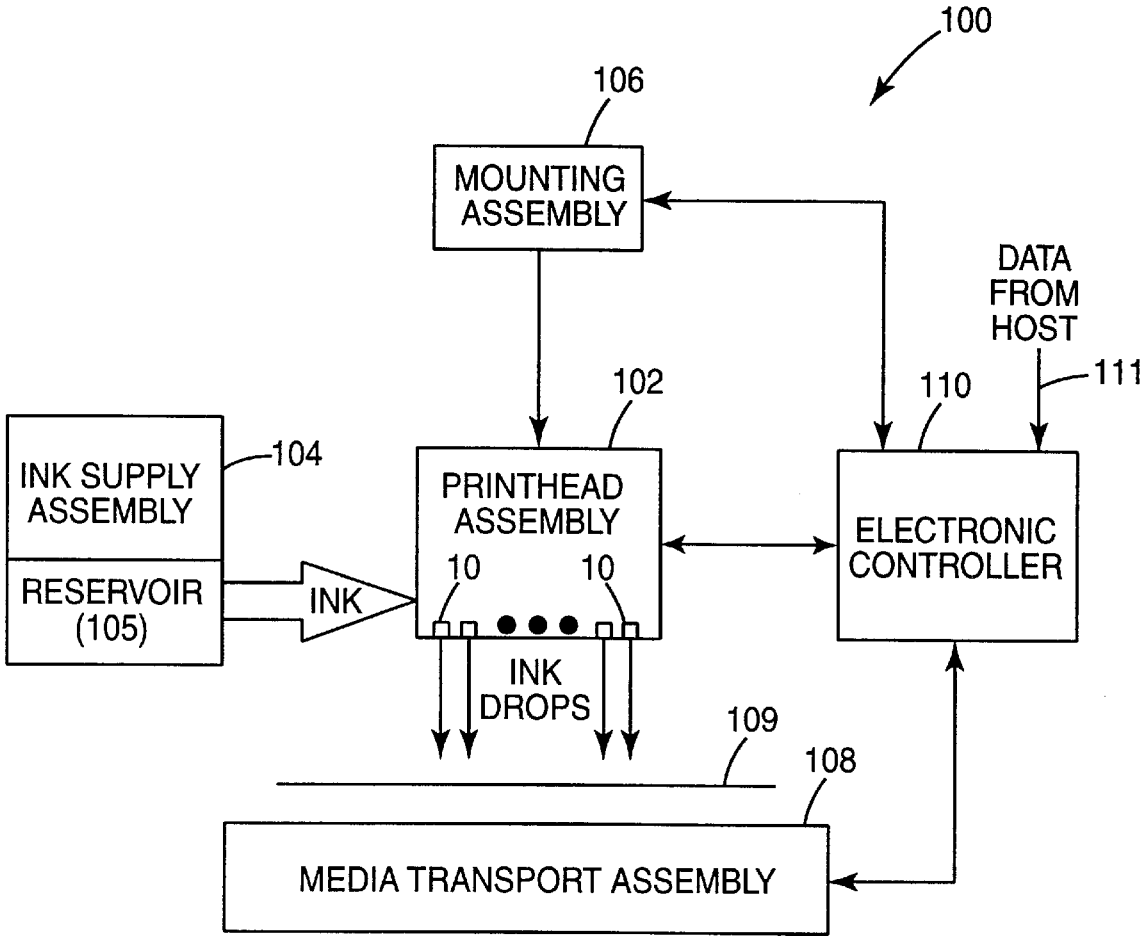
FIG. 15 is a block diagram illustrating one embodiment of an ink jet printing system including a plurality of fluid drop ejectors according to the present invention.

FIG. 15 illustrates one embodiment of an inkjet printing system 100 according to the present invention. Inkjet printing system 100 includes an inkjet printhead assembly 102, an ink supply assembly 104, a mounting assembly 106, a media transport assembly 108, and an electronic controller 110. Inkjet printhead assembly 102 includes one or more printheads each including a plurality of fluid drop ejectors 10, 10', 10", or 10'" which eject drops of ink onto a print medium 109. Print medium 109 is any type of suitable sheet material, such as paper, card stock, transparencies, and the like.

Typically, fluid drop ejectors 10, 10', 10", or 10'" are arranged in one or more columns or arrays. As such, properly sequenced ejection of ink from fluid drop ejectors 10, 10', 10", or 10'" causes characters, symbols, and/or other graphics or images to be printed upon print medium 109 as inkjet printhead assembly 102 and print medium 109 are moved relative to each other. In one embodiment, individual fluid drop ejectors 10, 10', 10", or 10'" may be provided for ejection of fluids with different properties such as inks of different colors.

Ink supply assembly 104 supplies ink to inkjet printhead assembly 102 and includes a reservoir 105 for storing ink. As such, ink flows from reservoir 105 to inkjet printhead assembly 102 and, more specifically, to fluid reservoir 26 of fluid drop ejectors 10, 10', 10", or 10'". In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 105 of ink supply assembly 104 may be removed, replaced, and/or refilled.

In one embodiment, where inkjet printhead assembly 102 and ink supply assembly 104 are housed together in an inkjet cartridge, reservoir 105 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108 and media transport assembly 108 positions print medium 109 relative to inkjet printhead assembly 102. In one embodiment, inkjet printhead assembly 102 is a scanning type printhead assembly. As such, mounting assembly 106 includes a carriage for moving inkjet printhead assembly 102 relative to media transport assembly 108 to scan print medium 109. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print medium 109 relative to inkjet printhead assembly 102.

Electronic controller 110 communicates with inkjet printhead assembly 102, mounting assembly 106, and media transport assembly 108. Electronic controller 110 receives data 111 from a host system, such as a computer, and includes memory for temporarily storing data 111. Typically, data 111 is sent to inkjet printing system 100 along an electronic, infrared, optical or other information transfer path. Data 111 represents, for example, a document and/or file to be printed. As such, data 111 forms a print job for inkjet printing system 100 and includes one or more print job commands and/or command parameters.

In one embodiment, electronic controller 110 provides control of inkjet printhead assembly 102 including timing control for ejection of ink drops from fluid drop ejectors 10, 10', 10", or 10'". As such, electronic controller 1 10 defines a pattern of ejected ink drops which form characters, symbols, and/or other graphics or images on print medium 109. Timing control and, therefore, the pattern of ejected ink drops, is determined by the print job commands and/or command parameters.

While the above description refers to inclusion of fluid drop ejectors 10 in an inkjet printing system 100, it is understood that fluid drop ejectors 10 may be incorporated into other fluid ejection systems including non-printing applications or systems such as a medical nebulizer. In addition, while the above description refers to ejection of fluid or ink from fluid drop ejectors 10, it is understood that any flowable material, including a liquid such as photoresist or flowable particles such as talcum powder, may be ejected from fluid drop ejectors 10.

By providing restriction 81 within fluid cavity 21 and, more specifically, positioning restriction 81 within fluid cavity 21 opposite orifice 41, a local pressure of fluid within fluid cavity 21 can be increased. More specifically, a pressure of fluid within confining region 89, as defined between flexible membrane 40 and restriction 81 and, if present, restricting wall 85, can be increased during deflection of flexible membrane 40 toward restriction 81. As such, increased fluid pressure within fluid cavity 21 can be achieved adjacent orifice 41 without having to increase a fluid pressure of the entire fluid cavity. Thus, it is not necessary to increase a stiffness of flexible membrane 40 to accommodate increased fluid pressure within fluid cavity 21.

By increasing a pressure of fluid within confining region 89 adjacent orifice 41, a velocity of droplet 12 as ejected from orifice 41 can be increased during operation of fluid drop ejector 10 and, more specifically, deflection of flexible membrane 40. By increasing a velocity of droplet 12 as ejected from orifice 41, potential affects of slow droplet velocities, such as trajectory errors, are minimized.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A fluid drop ejector, comprising:

a substrate having a fluid cavity defined therein;

a flexible membrane supported by the substrate and having an orifice defined therein which communicates with the fluid cavity;

an actuator associated with the flexible membrane and adapted to deflect the flexible membrane relative to the substrate in response to an electrical signal; and a restriction positioned within the fluid cavity opposite the orifice, wherein the restriction defines a confining region of the fluid cavity adjacent the orifice, and wherein a perimeter of the restriction is spaced from a sidewall of the fluid cavity.

2. The fluid drop ejector of claim 1, wherein the orifice has a first dimension and the restriction has a second dimension, wherein the second dimension is greater than the first dimension.

3. The fluid drop ejector of claim 2, wherein a ratio of the second dimension to the first dimension is in a range of approximately 2 to approximately 3.

4. The fluid drop ejector of claim 1, wherein the restriction is spaced a predetermined distance from the flexible membrane, wherein a ratio of the predetermined distance to a dimension of the orifice is in a range of approximately 1 to approximately 10.

5. The fluid drop ejector of claim 4, wherein the ratio of the predetermined distance to the dimension of the orifice is in a range of approximately 1 to approximately 3.

6. The fluid drop ejector of claim 1, wherein the restriction is supported from the sidewall of the fluid cavity.

7. The fluid drop ejector of claim 6, wherein the restriction is supported by at least one web extending from the sidewall of the fluid cavity.

8. The fluid drop ejector of claim 1, wherein the restriction is supported from a base of the fluid cavity.

9. The fluid drop ejector of claim 8, wherein the restriction is supported by a pedestal extending from the base of the fluid cavity.

10. The fluid drop ejector of claim 1, further comprising:

a restricting wall positioned within the fluid cavity and oriented substantially perpendicular to the restriction, wherein the restriction and the restricting wall define the confining region of the fluid cavity adjacent the orifice.

11. The fluid drop ejector of claim 10, wherein the restricting wall includes a plurality of spaced projections.

12. The fluid drop ejector of claim 10, wherein the restricting wall includes an annular projection.

13. The fluid drop ejector of claim 12, wherein the annular projection has a gap defined therein.

14. The fluid drop ejector of claim 10, wherein the restricting wall projects from the restriction toward the flexible membrane.

15. The fluid drop ejector of claim 10, wherein the restricting wall projects from the flexible membrane.

16. The fluid drop ejector of claim 10, wherein the restricting wall is concentric with the orifice.

17. The fluid drop ejector of claim 10, wherein the restricting wall is adapted to prevent foreign particles from entering the confining region.

18. The fluid drop ejector of claim 1, wherein the fluid cavity is adapted to hold a supply of fluid therein, wherein the fluid communicates with the orifice of the flexible membrane, and wherein the orifice of the flexible membrane defines a nozzle adapted to eject a droplet of the fluid in response to deflection of the flexible membrane.

19. The fluid drop ejector of claim 1, wherein the actuator is provided on a side of the flexible membrane opposite the fluid cavity.

20. The fluid drop ejector of claim 1, wherein the actuator includes a piezoelectric material.

21. A method of forming a fluid drop ejector, the method comprising the steps of:

defining a fluid cavity in a substrate;

supporting a flexible membrane by the substrate;

communicating an orifice of the flexible membrane with the fluid cavity;

positioning a restriction within the fluid cavity opposite the orifice, including spacing a perimeter of the restriction from a sidewall of the fluid cavity and defining a confining region within the fluid cavity adjacent the orifice; and associating an actuator with the flexible membrane, wherein the actuator is adapted to deflect the flexible membrane relative to the substrate in response to an electrical signal.

22. The method of claim 21, further comprising the step of:

forming the orifice in the flexible membrane with a first dimension, and wherein the step of positioning the restriction within the fluid cavity includes forming the restriction with a second dimension, wherein the second dimension is greater than the first dimension.

23. The method of claim 22, wherein a ratio of the second dimension to the first dimension is in a range of approximately 2 to approximately 3.

24. The method of claim 21, wherein the step of positioning the restriction within the fluid cavity includes spacing the restriction a predetermined distance from the flexible membrane, wherein a ratio of the predetermined distance to a dimension of the orifice is in a range of approximately 1 to approximately 10.

25. The method of claim 24, wherein the ratio of the predetermined distance to the dimension of the orifice is in a range of approximately 1 to approximately 3.

26. The method of claim 21, wherein the step of positioning the restriction within the fluid cavity includes supporting the restriction from one of the sidewall and a base of the fluid cavity.

27. The method of claim 21, further comprising the step of:

positioning a restricting wall within the fluid cavity, including orienting the restricting wall substantially perpendicular to the restriction, wherein the steps of positioning the restriction within the fluid cavity and positioning the restricting wall within the fluid cavity include defining the confining region within the fluid cavity adjacent the orifice.

28. The method of claim 27, wherein the step of positioning the restricting wall within the fluid cavity includes projecting the restricting wall from the restriction toward the flexible membrane.

29. The method of claim 27, wherein the step of positioning the restricting wall within the fluid cavity includes projecting the restricting wall from the flexible membrane.

30. The method of claim 27, wherein the step of positioning the restricting wall within the fluid cavity includes positioning the restricting wall concentric with the orifice.

31. The method of claim 21, wherein the step of supporting the flexible membrane includes supporting a periphery of the flexible membrane by the substrate.

32. The method of claim 21, wherein the step of associating the actuator with the flexible membrane includes providing the actuator on a side of the flexible membrane opposite the fluid cavity.

33. A method of ejecting droplets of a fluid, the method comprising the steps of:

supplying a fluid cavity with the fluid;

supporting a flexible membrane having an orifice defined therein over the fluid cavity, including communicating the orifice with the fluid cavity;

confining the fluid within the fluid cavity in a region adjacent the orifice with a restriction having a perimeter spaced from a sidewall of the fluid cavity; and deflecting the flexible membrane relative to the fluid cavity and ejecting a droplet of the fluid through the orifice of the flexible membrane.

34. The method of claim 33, wherein the step of confining the fluid within the fluid cavity in the region adjacent the orifice includes increasing a pressure of the fluid in the region adjacent the orifice during the step of deflecting the flexible membrane relative to the fluid cavity.

35. The method of claim 34, wherein ejecting the droplet of the fluid through the orifice of the flexible membrane includes increasing a velocity of the fluid from the orifice of the flexible membrane.

36. The method of claim 33, wherein the step of confining the fluid within the fluid cavity in the region adjacent the orifice further includes confining the fluid within the fluid cavity in the region adjacent the orifice with a restricting wall oriented substantially perpendicular to the restriction.

37. The method of claim 36, further comprising the step of:

preventing, with the restricting wall, foreign particles within the fluid cavity from entering the region adjacent the orifice.

38. The method of claim 36, wherein the step of deflecting the flexible membrane includes oscillating the flexible membrane and ejecting a plurality of droplets of the fluid through the orifice of the flexible membrane, and further comprising the step of:

stopping oscillation of the flexible membrane, including contacting the restricting wall with the flexible membrane.

39. The method of claim 38, wherein oscillating the flexible membrane includes applying an alternating voltage to an actuator associated with the flexible membrane, and wherein the step of stopping oscillation of the flexible membrane includes applying a constant voltage to the actuator associated with the flexible membrane.

40. An inkjet printing system, comprising:

a substrate having a plurality of fluid cavities formed therein;

a plurality of flexible membranes each supported by the substrate and having an orifice defined therein which communicates with one of the fluid cavities;

a plurality of restrictions each positioned within one of the fluid cavities opposite the orifice of a respective one of the flexible membranes, wherein each of the restrictions define a confining region of the one of the fluid cavities adjacent the orifice of the respective one of the flexible membranes, wherein a perimeter of each of the restrictions is spaced from a sidewall of a respective one of the fluid cavities; and a plurality of actuators each associated with one of the flexible membranes, wherein each of the flexible membranes is adapted to deflect in response to application of an electrical signal to an associated one of the actuators.

41. The inkjet printing system of claim 40, wherein each of the restrictions is supported from one of the sidewall and a base of the respective one of the fluid cavities.

42. The inkjet printing system of claim 40, wherein each of the restrictions is spaced a predetermined distance from the orifice of the respective one of the flexible membranes.

43. The inkjet printing system of claim 40, further comprising:

a plurality of restricting walls each positioned within one of the fluid cavities and oriented substantially perpendicular to an associated one of the restrictions, wherein a respective one of the restricting walls and the associated one of the restrictions define the confining region of the one of the fluid cavities adjacent the orifice of the respective one of the flexible membranes.

44. The inkjet printing system of claim 43, wherein each of the restricting walls project from the associated one of the restrictions toward the respective one of the flexible membranes.

45. The inkjet printing system of claim 43, wherein each of the restricting walls project from the respective one of the flexible membranes.

46. The inkjet printing system of claim 40, wherein each of the fluid cavities is adapted to hold a supply of fluid therein, wherein the fluid communicates with the orifice of an associated one of the flexible membranes, and wherein the orifice of each of the flexible membranes defines a nozzle adapted to eject a droplet of the fluid in response to deflection of the associated one of the flexible membranes.

* * * * *